US006669361B1

(12) United States Patent
Lizzi

(10) Patent No.: US 6,669,361 B1
(45) Date of Patent: Dec. 30, 2003

(54) METHOD FOR ENABLING/DISABLING MODE FUNCTIONS IN A MULTIMODE ELECTRONIC DEVICE

(75) Inventor: Ronald S. Lizzi, West Hartford, CT (US)

(73) Assignee: Times Group B.V. (NL)

( * ) Notice: Subject to any disclaimer, the term of this patent is extended or adjusted under 35 U.S.C. 154(b) by 0 days.

(21) Appl. No.: 09/727,886

(22) Filed: Nov. 30, 2000

(51) Int. Cl.[7] ..... G04C 9/00; G04C 19/00; G04C 5/00; G09G 3/18; G09G 5/00

(52) U.S. Cl. ..... 368/187; 368/82; 368/223; 368/243; 368/184; 345/51; 345/823

(58) Field of Search ..... 368/69–88, 139–204, 368/243–266, 184–187; 340/51, 953, 967, 973, 980, 982, 995.14, 995.27, 995.28, 463–464, 488, 825; 345/619, 626, 645, 713, 810, 814, 822–824, 828, 830, 859, 30–55; 349/33, 77–90

(56) References Cited

U.S. PATENT DOCUMENTS 4,283,784 A 8/1981 Horan
4,587,630 A * 5/1986 Straton et al. ..... 345/823
4,780,864 A 10/1988 Houlihan
4,783,773 A 11/1988 Houlihan et al.
4,989,188 A * 1/1991 Thinesen ..... 368/70
5,555,226 A 9/1996 Lizzi
5,587,971 A * 12/1996 Thinesen ..... 368/70
5,805,121 A * 9/1998 Burgan et al. ..... 345/50
5,861,797 A * 1/1999 Becker ..... 340/309.3
6,023,256 A * 2/2000 Ng et al. ..... 345/51
6,146,010 A 11/2000 Plancon
6,324,124 B1 * 11/2001 Yuzuki ..... 368/82

* cited by examiner

*Primary Examiner*—David Martin
*Assistant Examiner*—Michael L. Lindinger
(74) *Attorney, Agent, or Firm*—Carmody & Torrance LLP

(57) ABSTRACT

A method for enabling or disabling mode functions in a multimode electronic device is provided. The method comprises the steps of selecting a mode enabling/disabling mode from a plurality of modes by initiating activation of the mode selecting mechanism until the mode enabling/disabling mode is exhibited, causing the integrated circuit to enter the mode enabling/disabling mode, exhibiting at least mode function indicators for at least one of the exhibited mode functions within the plurality of modes as the mode selecting mechanism is cycling through the display of mode functions, and selecting the mode function for which enabling or disabling is desired and initiating the switching of the mode function from one of disabled to enabled if the mode function was disabled or one of enabled to disabled if the mode function was enabled. An electronic device that can carry out the foregoing methodology is also provided. In a preferred embodiment, the electronic device is a timepiece and specifically, a wristwatch.

14 Claims, 2 Drawing Sheets

METHOD FOR ENABLING/DISABLING MODE FUNCTIONS IN A MULTIMODE ELECTRONIC DEVICE

BACKGROUND OF THE INVENTION

The present invention relates generally to mode selecting methodologies for electronic devices, such as, but not limited to timepieces such as watches, and in particular, to an improved selecting methodology for an electronic device that includes the ability to manually enable and disable modes and their functions from within a larger set of a plurality of modes, thus being able to more particularly and desirably customize the functionality of the electronic device.

Watches having a plurality of modes are well known and described in a multitude of issued patents, such as, but not limited to commonly assigned, U.S. Pat. Nos. 4,783,773, issued Nov. 8, 1988 to Houlihan et al.; 4,780,864, issued Oct. 25, 1988 to Houlihan; U.S. Pat. No. 5,555,226, issued Sep. 10, 1996, to Ronald S. Lizzi and 4,283,784 issued Aug. 11, 1981 to Horan, the disclosures of which are incorporated by reference as if fully set forth herein.

There continues to be a push towards incorporating more and more functionality into such electronic devices, such as providing more and more modes that a user may find useful and/or desirable. Currently, the most common modes that may be found in such electronic devices (watches being used as an example, and not limitation) are: a time-of-day (TOD) mode, a date (DATE) mode, a chronograph (CHRONO) mode, an alarm setting (ALARM) mode, a countdown (TIMER) mode, and even an alternate time zone (T2) mode. All of these modes are now accessible in a number of ways, such as through the sequencing thereof using manually actuatable side and top pushers, and even more recently by the use of a rotating stem and/or top ring, as more particularly set forth in commonly assigned, co-pending U.S. patent application Ser. No. 09/264,523, filed on Mar. 8, 1999, entitled "Combined Crown and Pusher Electro Mechanism," by Michel G. Plancon, application Ser. No. 09/327,769, filed on Jun. 7, 1999, entitled "Crown Switching Mechanism," by Gerhard Stotz, and application Ser. No. 09/359,223, filed on Jul. 22, 1999, entitled "Setting Functions For A Multimode Timepiece" by G. Stotz, et al., the disclosures of which are incorporated by reference as if fully set forth herein.

As would be expected, watch designers, and programmers, are continuously striving for, constructing and/or designing such electronic devices, such as watches, to be more and more "user friendly." One such attempt is to provide a user with more and more available modes while at the same time attempting to permit the user to cycle through such modes more easily and conveniently.

A perceived deficiency in the prior art is not in the providing of users with more and more options, but rather of the information overload and frustration that such voluminous information availability causes. That is, what modes may be desirable for one user may be useless for another user. For example, a user who wants only the aforementioned TOD, CHRONO and ALARM mode may find it frustrating to be continually required to cycle through other unneeded modes, while a different user may only have a desired use for the TOD and T2 modes. As watches are programmed with additional features and mode availabilities, the potential for user information "overload" and frustration increases.

Accordingly, it is desirable to provide users with an ability to customize and more particularly configure the functionality of the electronic device in a manner that overcomes the foregoing perceived deficiencies. The present invention achieves the aforementioned and below mentioned advantages.

OBJECTS AND SUMMARY OF THE INVENTION

Accordingly, it is an object of the present invention to provide an improved programming and mode selecting methodology for multimode electronic devices and, in particular, to provide an improved methodology that allows users to customize and more particularly configure the functionality of the electronic device, and, in particular, of a wristwatch.

It is another object and advantage of this invention to provide an improved mode selecting methodology for such electronic devices that makes the device more "user friendly."

It is yet another object and advantage of this invention to provide an improved mode selecting methodology that permits for a simpler user interface that makes the device more marketable to a wider range of users.

It is still another object and advantage of this invention to provide an improved mode selecting methodology that permits manufactures, designers or programmers of such devices to further provide users with demanded functionality, yet provide a construction and methodology to permit the user to individually customize the device to better meet the users needs and desires therefor.

It is a further object of the present invention to provide a multimode device that can provide additional mode capability and functionality.

Another object of the present invention is to provide a device having an improved multi-level user interface.

Another object of the present invention is to provide a device having multi-level mode capabilities that is easy for a user to access.

Further objects and advantages of this invention will become more apparent from a consideration of the drawings and ensuing description.

The foregoing and other problems are overcome and the objects and advantages are realized by methods and constructions in accordance with embodiments of this invention, wherein improved mode selecting and programming methodologies and a construction thereof for a multimode electronic device are disclosed.

Generally speaking, a method for enabling or disabling mode functions in a multimode electronic device of the type having a mode selecting mechanism and an integrated circuit operable in at least a mode selecting mode and a mode enabling/disabling mode is provided. In a preferred embodiment, the method comprising the steps of selecting a mode enabling/disabling mode from a plurality of modes by initiating activation of the mode selecting mechanism until the mode enabling/disabling mode is exhibited, causing the integrated circuit to enter the mode enabling/disabling mode, exhibiting at least mode function indicators for at least one of the exhibited mode functions within the plurality of modes as the mode selecting mechanism is cycling through the display of mode functions, and selecting the mode function for which enabling or disabling is desired and initiating the switching of the mode function from one of disabled to enabled if the mode function was disabled or one of enabled to disabled if the mode function was enabled. In one particular embodiment, the mode selecting mechanism includes a rotating switching mechanism, and the method includes the step of selecting the mode enabling/disabling mode by rotating the switching mechanism in a first or second direction until the mode enabling/disabling mode is exhibited and causing the integrated circuit to enter the mode enabling/disabling mode by the displacement of the rotating switching mechanism from a first position to a second position. Additionally, the step of initiating the switching of the mode function from one of disabled to enabled or one of enabled to disabled is preferably achieved by the step of pressing a button that is operatively coupled to the integrated circuit.

The present invention is also directed to an electronic device that can carry out the foregoing methodology. In a preferred construction, the device includes an integrated circuit operable (a) in at least a mode selecting mode in which the device is capable of cycling among and between a plurality of modes, and (b) a mode enabling/disabling mode for selectively enabling or disabling one or more of the plurality of modes; a switching mechanism for cycling among the plurality of modes, for selecting the mode enabling/disabling mode and for entering the mode enabling/disabling mode; means for exhibiting at least mode function indicators for each exhibited mode function within the plurality of modes; and an enabler/disabler for enabling a mode function if the mode was disabled or disabling the mode function if the mode was enabled. Similarly, the switching mechanism may be a rotating switching mechanism. In a preferred embodiment, the electronic device is a timepiece and specifically, a wristwatch.

DETAILED DESCRIPTION OF THE PREFERRED EMBODIMENT

As set forth in the Background Section above, and as will be appreciated below, there are many mechanical embodiments that can carry out the present invention. The preferred mechanical embodiment incorporates a rotating switching mechanism as disclosed in the aforementioned co-pending applications. However it should be understood that use of side and/or top mounted pushers are contemplated herein to carry out the present invention.

Generally speaking, the present invention provides a user the ability to enable and/or disable mode functions that are provided for in the electronic device, such as within a "library" of modes stored within the memory of the electronic device. In one embodiment, all the modes may initially be enabled thus requiring a user to disable the undesired mode functions. Alternatively, all mode functions could be initially disabled, wherein a user must systematically enable them if desired. Still further, the device could be initially set up whereby certain modes, such as for example, the TOD mode, are enabled (and may not even be capable of disabling) while optional modes must be enabled if desired. All of these features and contemplated constructions are well within the purview of the skilled artisan having studied the present disclosure.

Figure 1:
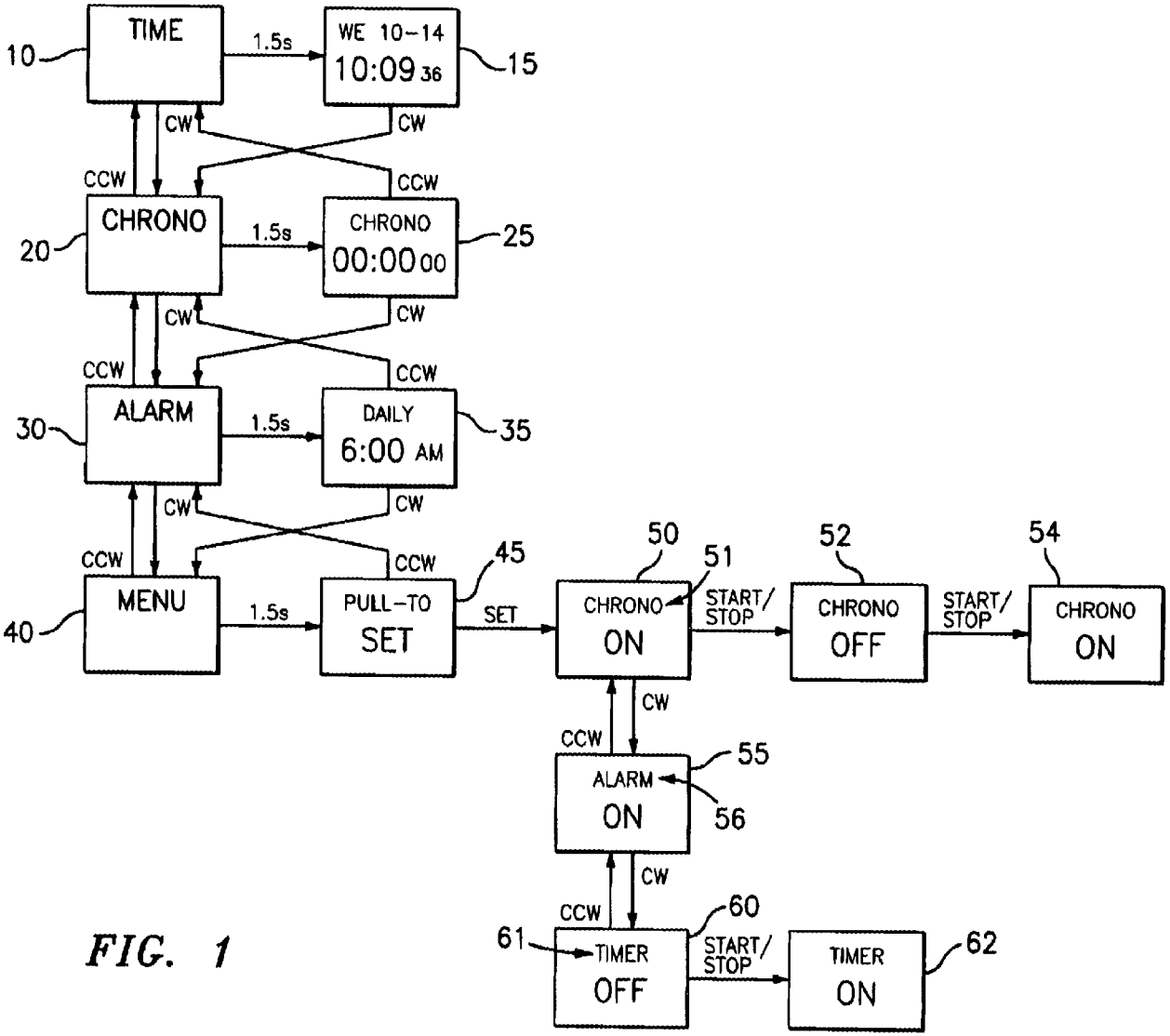
FIG. 1 illustrates a flow diagram of a mode enabling/disabling methodology in accordance with the present invention, provided to be used in connection with an electronic device, such as, but not limited to, a watch.

To set forth the preferred methodology of the present invention, reference should be had to FIG. 1. It should be understood that the following has been simplified to clearly explain the implementation of the present invention. Such simplification should be understood as exemplary and not by way of limitation. For example, the mode selector may be a dedicated pusher (hereinafter coined the "mode button") as would be well known in the art, or may be comprised of a rotating switching mechanism that is positionable in at least two axial positions, such as that disclosed in co-pending application Ser. No. 09/327,769. The included integrated circuit is operable in at least an active mode state being the mode in which the device may be in (i.e. TOD, DATE, ALARM, etc.), a mode selecting mode in which the device is capable of cycling among and between a plurality of mode states, and a mode enabling/disabling mode. The mode button may permit operatively cycling among the modes or the rotating switching mechanism may perform this function when it is the first of the two axial positions. Selection of a next mode from a plurality of modes may be achieved by rotating the switching mechanism either clockwise or counterclockwise until the next active mode is exhibited. Continued depression of the mode button would achieve the same effect. Once the mode enabling/disabling mode is selected, entering the mode enabling/disabling mode may be achieved by positioning the switching mechanism in the second of the two axial positions. Thereafter, rotating it in a clockwise or counterclockwise direction once in the mode enabling/disabling mode can change the display of the mode functions and provide for enabling and disabling the mode functions as disclosed below. A selected button, which may even be a dedicated button (but need not be as discussed below), such as a "mode enabling/disabling" button may be used to enable a mode function if the mode function was disabled or may be used to disable a mode function if the mode function was previously enabled.

In the example illustrated of FIG. 1, each actuation of the mode button or, if the device incorporates a rotating switching mechanism, each clockwise (CW) or counterclockwise (CCW) rotation of the switching mechanism (while in its first position) selects the next mode from within a Mode List. For example, it may be assumed that the device is in the TOD mode (BLOCK 10). The next mode accessible in the Mode List by depression of the mode button or rotation of the switching mechanism in the CW direction would be displayable on the device's display and in the present example, would be the CHRONO mode (Block 20). Further CW rotation causes the ALARM mode banner to be displayed (Block 30). Without further actuation of the mode button or without further rotation of the rotating switching mechanism after the exhibiting of the selected mode, the device preferably enters the particular mode (i.e. Block 15, or Block 25, or Block 35 respectively). In this way, setting of the particular mode occurs. Preferably, non-rotation of the rotating switching mechanism or non-depression of the mode button for 1.5 seconds will cause the device to enter the selected mode. The utilization of the 1.5-second delay permits a user to identify the particular mode for which entry may be desired. Much of the foregoing software methodology exists in watches on the market.

In accordance with the present invention, one of the available modes is the Enable/Disable (E/D) mode. It is within this mode that additional mode functions may be enabled to be used by the user or disabled to be removed from use.

For example, in the present embodiment continued rotation in the CW direction from the ALARM mode causes the E/D mode banner to be displayed (Block 40). Waiting the exemplary 1.5 seconds causes the device to enter the E/D mode, whereby the display may display a banner "PULL TO SET" (Block 45). Moving the rotating switching mechanism to its second axial position will enable the device to cycle between and among the available library of mode functions (likewise, a user could reach Block 45 by the depression of a pushbutton). Thus, the device enters the mode enabling/disabling mode (Block 50). Repeated depression of a selected pushbutton or the clockwise/counterclockwise rotation of the switching mechanism in its now second position causes the exhibiting of at least each modes function indicator (see reference numerals 51, 56 and 61 by way of example) for each exhibited mode function within the plurality of modes. Once the particular mode function for which enabling or disabling is desired is selected, a user initiates the switching of the function from one of disabled to enabled if the mode function was disabled or one of enabled to disabled if the mode function was enabled.

The mode enabling/disabling button can be used to toggle the enable/disable function of the particular mode. In the illustrated example, the CHRONO mode function is the first mode function to appear in the E/D mode (Block 50), and in the present example, is currently enabled (this can be seen by way of the "ON" indicator). Depression of the selected enable/disable (e/d) button would disable the CHRONO mode function (Block 52). Preferably the display would indicate the disablement of the feature by way of an "OFF" or "DISABLED" indication. Depression of the selected enable/disable button a second time, if desired, once again would enable the CHRONO mode function (Block 54).

Continuing with the flow diagram of FIG. 1, continued rotation of the switching mechanism in the illustrated CW or CCW direction while in its second axial position would cause additional mode functions to appear on the display. For example, following the CHRONO mode function would appear the ALARM mode function (Block 55), and following the ALARM mode function would appear the TIMER mode function (Block 60). Again, depression of the e/d button would, in the present example, turn the TIMER feature "ON" (Block 62) as the present example assumed it was "OFF" or "DISABLED."

Positioning the setting stem back in its first axial position causes the device to return to its mode selecting mode so as to permit the device to one again cycle among and between the modes that are enabled. However, it will now be appreciated that the TIMER mode would now be one of the modes that are available to the user. In such a case continued rotation of the setting stem would cause the TIMER mode to appear on the display before the TOD mode (Block 10) reappears if one is cycling in a single direction (i.e. CW).

While the foregoing sets forth the methodology for carrying out the preferred embodiment of the present invention, some points should be made for completeness. For example, once in the particular mode, such as TOD, CHRONO or ALARM, setting information within the mode can be done in accordance with known methodologies, such as those set forth in the applications incorporated by reference herein. However, such setting of the time, alarm, or other information forms no part of the present invention. Moreover, it is envisioned that there could be a dedicated e/d button. However, any button, such as a start/stop or other button could be used. That is, it is well within the scope of one skilled in the art to provide a multifunctioning button that has a plurality of functions depending on the mode within which the device is in. For example, in the TIMER mode, a "start/stop" may function to start and stop the timer, but when in the E/D mode, the "start/stop" button functions as the e/d button. Therefore, the number of actual buttons can be kept to a minimum.

It is also envisioned that software can be implemented so as to order the modes in a way that is desirable to the user. That is, in the example noted above, the TIMER mode would be enabled at Block 60. What is not explicitly provided as an option to the user is to select where in the sequence of modes the user would see the TIMER mode. However, this additional feature would be desirable and is contemplated by the present inventor.

Figure 2:
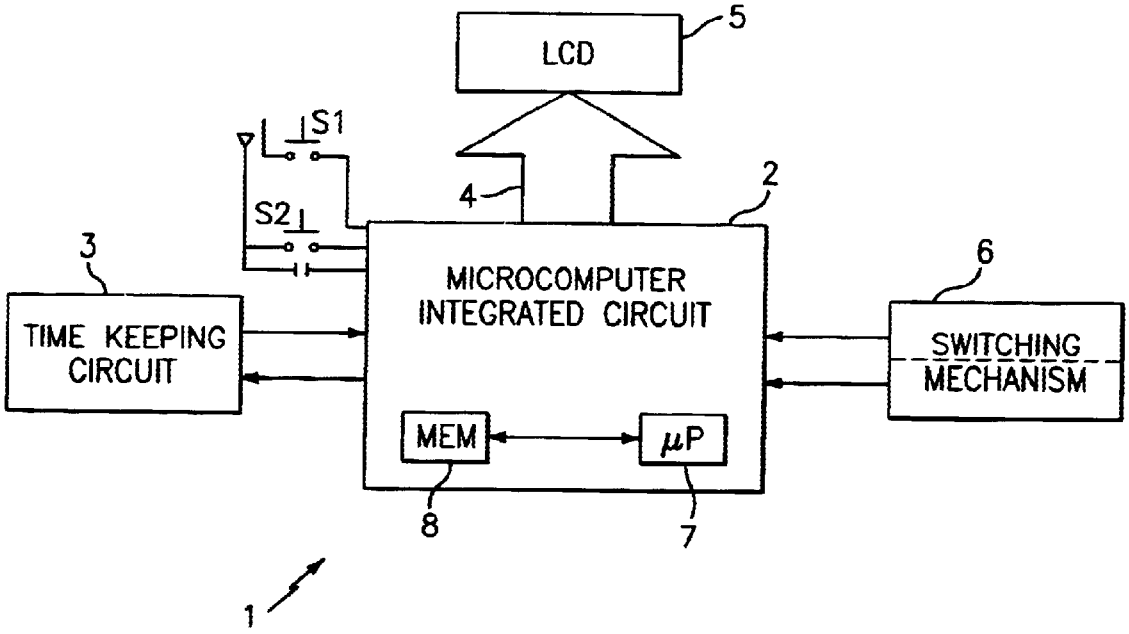
FIG. 2 is a simplified block diagram of an integrated circuit and other components of a multimode electronic device constructed to carry out the present invention.

Lastly, while the present methodology, as repeatedly stated above, is essentially independent of the mechanical embodiment used to carry it out, it is preferred that some disclosure be provided. FIG. 2 illustrates components of circuitry of a multimode, multifunctioning electronic timepiece 1 configured in accordance with the present invention. The circuitry is disposed within a cavity of the device's casing (not shown) and may be operable for performing, among other things, timekeeping functions. The circuitry includes a programmable microcomputer 2 in the form of an integrated circuit chip, preferably bonded to a printed circuit board (not shown). The microcomputer 2 includes a microprocessor 7 programmed to perform instructions suitable for achieving the timekeeping functions and all the mode selecting and operating as disclosed above. The microcomputer also includes a memory device 8. The memory device 8 may store, for example, data values and/or variables used by the microprocessor 7 in one or more operating modes of the device. In particular, the memory device may store the electronic timepiece setting and mode selecting methodologies as software routines retrieved and executed by microprocessor 7 in accordance with the present invention. As can be appreciated, the circuitry may also includes a timekeeping circuit 3, which generates time indicating signals representing, among other things, a time-of-day. Signals from the timekeeping circuit 3 as well as other signals from, for example, the switching mechanism, whether by the switching mechanism 6 which may comprise the aforementioned rotating switching mechanism or may comprise pushbuttons S1 and/or S2, are processed by the microcomputer 2. For example, a first set of input signals may be generated as the switching mechanism 6 is operated within predetermined axial setting positions, and a second set of input signals may be generated when the switching mechanism 6 is rotating in a CW or CCW direction. The input signals are passed to the microprocessor 7 for processing to change, for example, the value of information or mode banners on the display through a predetermined sequence. In this regard, control signals may be directed to the timekeeping circuit 3 from the microcomputer 2 to set or change one or more values within the timekeeping circuit 3. In accordance with the present invention and as more particularly disclosed above, the switching mechanism 6 and the input signals may supplement or, preferably, replace the signals generated from the actuation of pushers during conventional setting functions, although conversion of the device to operate with pushers is contemplated herein. For this purpose switches S1 and S2 are provided and constructed in a very well known manner. Further one of the switches, such as S1 can be used as the aforementioned enable/disable button for the initiating of the switching of the mode function from enabled to disabled or from disabled to enabled as set forth above. Other details of the workings of the device, such as the lamp or how the high frequency time base is established is so well known in the art that no further details need be made thereto. In the preferred embodiment, the switching mechanism 6 includes a crown coupled to a setting stem and a switching device (not shown) and all in accordance with the construction set forth in the aforementioned co-pending applications.

An output signal via a display bus 4 is provided to a display such as, for example, a liquid crystal display 5. The LCD 5 exhibits the time of day, other time measuring quantities, and other information as set forth and indicated above and/or as instructed by the microcomputer 2.

It will thus be seen that the objects set forth above, among those made apparent from the preceding description, are efficiently attained and, since certain changes may be made in the above constructions and methodologies without departing from the spirit and scope of the invention, it is intended that all matter contained in the above description or shown in the accompanying drawings shall be interpreted as illustrative and not in a limiting sense.

While the invention has been particularly shown and described with respect to preferred embodiments thereof, it will be understood by those skilled in the art that changes in form and details may be made therein without departing from the scope and spirit of the invention.

For example, the present invention can easily be modified to select a mode enabling/disabling mode from a plurality of modes by initiating activation of the mode selecting mechanism until the mode enabling/disabling mode is exhibited, cause the integrated circuit to enter the mode enabling/disabling mode, and exhibit at least mode function indicators for groups of exhibited mode functions within the plurality of modes as the mode selecting mechanism is cycling through the display of groups of mode functions. That is, instead of exhibiting indicators for particular modes (i.e. TIMER, ALARM, CHRONO, DATE, etc.) the present invention recognizes that groups of modes may be selected together. That is, the corresponding individual modes could be replaced by the display and enablement/disablement of groups of modes (i.e. SPORTS, TRAVEL, TIMEZONES) within which there are a plurality of even more particularized modes.

In one embodiment, the entire group of modes are enabled or disabled together.

In this embodiment, the invention comprises the step of selecting the group of mode functions for which enabling or disabling is desired and initiating the switching of the group of mode functions from one of disabled to enabled if the group of mode functions was disabled or one of enabled to disabled if the group of mode functions was enabled. In a further feature of the present invention, the method may include the steps of enabling a selected group of mode functions and selecting a first mode function from the selected group of mode functions for which enabling or disabling is desired and initiating the switching of the first mode function from one of disabled to enabled if the first mode function was disabled or one of enabled to disabled if the first mode function was enabled. In this way, further individual modes within a selected group of modes could be enabled or disabled so as to further customize and particularize the electronic device for the user. In this regard, the present invention may include the step of exiting the mode enabling/disabling mode and returning to the mode selecting mode and continue cycling among and between the modes that are enabled and now having at least the first mode function within the selected group of mode functions displayed during the cycling step whereby the first mode function was not being displayed prior to its enablement. In this manner, only selected mode functions within the group are displayed after enablement. Similarly, the method as claimed may only require the steps of enabling a selected group of mode functions and exiting the mode enabling/disabling mode and returning to the mode selecting mode and continue cycling among and between the modes that are enabled and now having the mode functions within the selected group of mode functions displayed during the cycling step whereby the selected group of mode functions was not being displayed prior to its enablement. In this way, all the modes within a group of modes are enabled at once.

Lastly, the present invention has been disclosed above with particular reference to timepieces. However, one skilled in the art shall now appreciate that the present invention is equally applicable, and as claim herein, to devices other than timepieces, such as, but not limited to, clocks and security devices, such as wall mounted or hand-held devices for the home or office. Therefore, reference to a device in both the disclosure and the claims should be understood to refer to at least any of the aforementioned other devices. That is, the present invention is applicable in any electronic device such as those disclosed in which particular modes and their functions can be enabled or disabled, in a manner disclosed herein.

What is claimed is:

1. A method for making the function of a disabled mode available for selecting in a multimode electronic device of the type having an integrated circuit operable in a plurality of modes comprising the disabled mode and a plurality of enabled modes comprising a mode enabling/disabling mode, wherein the enabled modes are available for selection and the integrated circuit is further operable in a mode selection mode for selecting among the plurality of enabled modes, the method comprising the steps of:

cycling among the enabled modes and entering the mode enabling/disabling mode by initiating activation of a mode selecting mechanism;

displaying at least a mode indicator for the disabled mode;

selecting the disabled mode for which enabling is desired and switching the disabled mode from one of disabled to enabled so that a function of the previously disabled mode is selectable; and exiting the mode enabling/disabling mode and resume cycling among the enabled modes;

wherein during the resuming of the, cycling among the enabled modes, the previously disabled mode will now be one of the enabled modes and available for selecting in the mode selection mode; and wherein the integrated circuit disables the selectability of the function of the disabled mode prior to the enablement of the disabled mode during a switching step.

2. The method as claimed in claim 1, wherein the mode selecting mechanism includes a rotating switching mechanism, and the method includes the step of:

selecting the mode enabling/disabling mode by rotating the switching mechanism in a first or second direction until the mode enabling/disabling mode is exhibited.

3. The method as claimed in claim 1, including the step of causing the integrated circuit to enter the mode enabling/disabling mode by the passing of predetermined period of time without further exhibiting of additional enabled modes.

4. The method as claimed in claim 2, wherein the step of causing the integrated circuit to enter the mode enabling/disabling mode is achieved by the displacement of the rotating switching mechanism from a first position to a second position.

5. The method as claimed in claim 1, wherein the step of initiating the switching of the mode function from one of disabled to enabled or one of enabled to disabled is achieved by the step of pressing a button that is operatively coupled to the integrated circuit.

6. An electronic device of the type having at least a mode selecting mode in which the device is capable of selecting among a plurality of enabled modes comprising a mode enabling/disabling mode for selectively enabling or disabling at least one of the modes, the electronic device comprising:

a switching mechanism for cycling among the enabled modes, for selecting the mode enabling/disabling mode and for entering the mode enabling/disabling mode;

means for displaying at least a mode indicator for each of the modes; and an enabler/disabler for enabling a mode if the mode was disabled or disabling the mode if the mode was enabled;

wherein an integrated circuit is operable in the mode selecting mode and makes available for selecting a previously disabled mode that was not available for selecting prior to its enablement; and wherein during the cycling among the enabled modes, the integrated circuit makes a disabled mode unavailable for selecting in the mode selection mode although the disabled mode was available for selecting prior to its disablement.

7. The electronic device as claimed in claim 6, wherein the switching mechanism is a rotating switching mechanism positionable in at least two axial positions and operatively coupled to the integrated circuit, and wherein the rotating switching mechanism cycles among the plurality of modes when the rotating switching mechanism is rotated in a first or second direction and enters the mode enabling/disabling mode by positioning the switching mechanism in a second of the at least two axial positions.

8. The electronic device as claimed in claim 6, wherein the mode to be disabled is selected by the stopping of rotation of the switching mechanism when the selected mode is displayed.

9. The electronic device as claimed in claim 8, including a button operatively coupled to the integrated circuit, said button for operatively causing the selected mode to be enabled if previously disabled or disabled if previously enabled.

10. The electronic device as claimed in claim 6, wherein said electronic device is a timepiece.

11. The electronic device as claimed in claim 6, wherein the timepiece is a wristwatch.

12. A method for making an enabled mode unavailable for selecting in a mode selection mode in a multimode electronic device of the type having an integrated circuit operable in a plurality of enabled modes comprising a selected mode and a mode enabling/disabling mode, and wherein the integrated circuit is further operable in a mode selection mode for selecting among the plurality of enabled modes, the method comprising the steps of:

cycling among the enabled modes and entering the mode enabling/disabling mode by initiating activation of a mode selecting mechanism;

displaying at least a mode indicator for the selected mode;

selecting the selected mode for which disabling is desired and switching the selected mode from one of enabled to disabled so that the selected mode is not available among the enabled modes for selecting; and exiting the mode enabling/disabling mode and resume cycling among the enabled modes;

wherein during the resuming of the cycling among the enabled modes, the disabled selected mode will not be selectable in the mode selection mode and wherein the selected mode was selectable in the mode selection mode prior to its disablement during the selecting step.

13. A method for making the functions of a group of disabled modes available for selection in a multimode electronic device of the type having an integrated circuit operable in a plurality of modes comprising the group of modes to be disabled and a plurality of enabled modes comprising a mode enabling/disabling mode, and wherein the integrated circuit is further operable in a mode selection mode for selecting among the plurality of enabled modes, the method comprising the steps of:

cycling among the enabled modes and entering the mode enabling/disabling modes by initiating activation of the mode selecting mechanism;

displaying at least a mode indicator for the disabled group of modes;

selecting the disabled group of modes for which enabling is desired and switching the disabled group of modes from one of disabled to enabled so that at least one function in each of the disabled modes is selectable; and exiting the mode enabling/disabling mode and resume cycling among the enabled modes;

wherein during the resuming of the cycling among the enabled modes, the previously disabled group of modes will be now be among the enabled modes and available for selecting in the mode selection mode, and wherein the integrated circuit disables the selectability of the at least one function of each disabled mode of the disabled group of modes prior to the enablement of the disabled group of modes during a switching step.

14. A method for making a group of enabled modes unavailable for selecting in a mode selection mode in a multimode electronic device of the type having an integrated circuit operable in a plurality of enabled modes comprising a selected group of modes and a mode enabling/disabling mode, and wherein the integrated circuit is further operable in a mode selection mode for selecting among the plurality of enabled modes, the method comprising the steps of:

cycling among the enabled modes and entering the mode enabling/disabling mode by initiating activation of the mode selecting mechanism;

displaying at least a mode indicator for the selected group of modes;

selecting the selected group of modes for which disabling is desired and switching the selected group of modes from one of enabled to disabled; and exiting the mode enabling/disabling mode and resume cycling among the enabled modes;

wherein during the resuming of the cycling among the enabled modes, the disabled selected group of modes will not be selectable in the mode selection mode and wherein the selected group of modes was selectable from the mode selection mode prior to their disablement during a switching step.

* * * * *

UNITED STATES PATENT AND TRADEMARK OFFICE

CERTIFICATE OF CORRECTION

PATENT NO. : 6,669,361 B1
DATED : December 30, 2003
INVENTOR(S) : Ronald S. Lizzi It is certified that error appears in the above-identified patent and that said Letters Patent is hereby corrected as shown below:

Title page,
Item [73], Assignee, should read -- [73] Assignee: Timex Group B.V. (NL) --

Column 8,
Line 40, delete "," between "the" and "cycling"

Column 9,
Line 35, insert -- enabled or -- between "be" and "disabled"

Signed and Sealed this

Second Day of March, 2004

JON W. DUDAS
*Acting Director of the United States Patent and Trademark Office*